US005221590A

United States Patent [19]

Bugner

[11] Patent Number: 5,221,590

[45] Date of Patent: Jun. 22, 1993

[54] PHOTOELECTROGRAPHIC IMAGING WITH DYES OR PIGMENTS TO EFFECT A COLOR DENSITY OR HUE SHIFT

[75] Inventor: Douglas E. Bugner, Rochester, N.Y.

[73] Assignee: Eastman Kodak Company, Rochester, N.Y.

[21] Appl. No.: 685,343

[22] Filed: Apr. 15, 1991

[51] Int. Cl.[5] ..... G03G 5/06

[52] U.S. Cl. ..... 430/56; 430/58; 430/70; 430/280

[58] Field of Search ..... 430/56, 58, 70, 280

[56] References Cited

U.S. PATENT DOCUMENTS

| | | | |
|---|---|---|---|
| 3,112,200 | 11/1963 | Wainer | 96/90 |
| 3,681,066 | 8/1972 | McGuckin | 96/1 |
| 3,765,883 | 10/1973 | Endo et al. | 430/280 |
| 3,879,197 | 4/1975 | Bartlett et al. | 96/1 |
| 4,008,085 | 12/1977 | Lemahieu et al. | 96/48 R |
| 4,042,388 | 8/1977 | Inoue et al. | 430/156 |
| 4,650,734 | 3/1987 | Molaire et al. | 430/7 |
| 4,659,649 | 4/1987 | Dickinson et al. | 430/280 |
| 4,661,429 | 4/1987 | Molaire et al. | 430/70 |
| 4,672,021 | 6/1987 | Blumel et al. | 430/191 |
| 4,701,402 | 10/1987 | Patel et al. | 430/332 |
| 4,777,111 | 10/1988 | Blumel et al. | 430/156 |
| 4,945,020 | 7/1990 | Kempf et al. | 430/49 |

FOREIGN PATENT DOCUMENTS

| | | |
|---|---|---|
| 1752389 | 3/1986 | European Pat. Off. . |
| 290750A | 11/1988 | European Pat. Off. . |
| 74/029466 | 5/1978 | Japan . |
| 56-025744 | 3/1981 | Japan . |
| 1289529 | 9/1972 | United Kingdom . |
| 1424323 | 2/1976 | United Kingdom . |

OTHER PUBLICATIONS

C. L. Renschler, *Proceedings of the ACS Division of Polymeric Materials: Science and Engineering*, 60, 260 (1989).

D. R. McKean et al., *Proceedings of the ACS Division of Polymeric Materials: Science & Engineering*, 60, 45 (1989).

*Primary Examiner*—Marion E. McCamish

*Assistant Examiner*—S. Rosasco

*Attorney, Agent, or Firm*—Michael L. Goldman; Willard G. Montgomery; Alfred P. Lorenzo

[57] ABSTRACT

The present invention relates to a photoelectrographic element having a conductive layer in electrical contact with an acid photogenerating layer which is free of photopolymerizable materials and contains an electrically insulating binder and an onium acid photogenerator. A dye or pigment which undergoes a color density or hue shift upon exposure with radiation is included in the photoelectrographic element. A method for forming images with this element is also disclosed.

28 Claims, No Drawings

PHOTOELECTROGRAPHIC IMAGING WITH DYES OR PIGMENTS TO EFFECT A COLOR DENSITY OR HUE SHIFT

FIELD OF THE INVENTION

This invention relates to new photoelectrographic elements containing dyes or pigments to effect a color density or hue shift and an imaging method for using such elements.

BACKGROUND OF THE INVENTION

Imaging elements, such as those described in U.S. Pat. Nos. 4,661,429 and 4,650,734, as well as U.S. Pat. No. 3,681,066, German Democratic Republic Patent No. 155,270 and Japanese Patent No. 103,260, are useful for "expose once, print many times" applications, also known as electrographic printing, or xeroprinting. These elements differ from others in that they comprise a conductive layer in electrical contact with an acid photogenerating layer which (i) is free from polymerizable monomers and (ii) comprises an electrically insulating binder and an acid photogenerator. Other important differences between these elements and similar prior art systems are that the light-induced conductivity is persistent for much longer periods of time and that it is bipolar, i.e., the element can be charged to either a positive or negative potential with equivalent results. Furthermore, unlike other photoelectrographic elements, the elements of the type described in U.S. Pat. No. 4,661,429 require no pre- or post-exposure treatment or processing of any kind prior to their use in an electrographic printing process, nor does the electrographic printing cycle, as further described hereinafter, require any further exposure steps.

One potential drawback to elements of this type is that the electroconductive latent image may be invisible or poorly visible, especially when the actinic radiation is not in the visible region of the electromagnetic spectrum, e.g., ultraviolet, infrared, or x-ray radiation. In many applications employing these and similar elements, it would be desirable to visualize the electroconductive latent image.

Dyes have been used in conjunction with acid photogenerators to effect color density or hue shifts for a variety of applications outside of elements for photoelectrographic printing processes. U.S. Pat. No. 4,701,402 to Patel et al. utilizes an element containing a bleachable dye in reactive association with an iodonium ion for making overhead transparencies or color slides by exposing a printed or typed original. European Patent Application No. 175,238A to Ishii et al., discloses a similar non-electrographic, direct imaging process with a photosensitive composition including a photoactivator, such as an aromatic halonium salt. U.S. Pat. No. 4,659,649 to Dickinson et al. discloses a coating for silk screen stencils or lithographic printing plates containing a photocurable resin, an onium salt, and a dyestuff. European Patent Application No. 290,750A to Mullis discloses a composition containing a photoacid-progenitor and a dye which can be incorporated in various materials to indicate exposure to U.V. radiation. D. R. McKean et al., *Proceedings of the ACS Division of Polymeric Materials: Science & Engineering,* 60, 45 (1989) incorporates merocyanine dyes into a photoresist formulation containing a triphenylsulfonium salt to achieve bleaching proportional to U.V. irradiance and to measure yields for photoacid Production. U.S. Pat. Nos. 4,672,021 and 4,777,111 to Blumel et al. relate to a photographic element containing a light sensitive material which generates an acid upon exposure and a dye.

Dyes have also been used in conjunction with radical photogenerators to effect color density or hue shifts for a variety applications outside of elements for photoelectrographic printing processes. For example, imaging elements comprising one or more layers over a conductive substrate and which further comprise reactive combinations of polyhalogen compounds or diazonium salts and dye precursor compounds have been disclosed in U.S. Pat. No. 3,765,883 to Endo et al., U.S. Pat. No. 4,042,388 to Inoue et al., British Patent No. 1,289,529 to Canon KK, British Patent No. 1,424,323 to Vanheertum and Japanese Patent Application Nos. 74/029,466 and 53/003,827. Japanese Patent Application No. 56/025,744 to Ricoh describes similar elements in which a color forming layer is used as an integral mask in conjunction with photoconductive layers. Although the elements of these references are useful for certain imaging applications, they do not result in an electroconductive latent image.

There have also been disclosures relating to various photoelectrographic imaging elements, comprising a conductive layer and a photosensitive layer with an acid photogenerator and a dye. U.S. Pat. No. 3,879,197 to Bartlett et al. utilizes a photosensitive layer containing leuco xanthene dyes and organic halogen compounds capable of forming acids with no mention of a color density or hue shift. U.S. Pat. No. 4,945,020 to Kempf et al. relates to an element with a photosensitive layer comprising a leuco dye and a nonionic halogenated compound. This element has a slow charge decay rate which would preclude its use in high speed printing processes. Such elements are further limited to a print-out process described infra.

SUMMARY OF THE INVENTION

The present invention relates to a photoelectrographic element comprising a conductive layer in electrical contact with an acid photogenerating layer. The acid photogenerating layer is free of photopolymerizable materials and includes an electrically insulating binder, an onium acid photogenerator, and, optionally, a spectral sensitizer, in accordance with U.S. Pat. No. 4,661,429. The present invention constitutes an improvement over U.S. Pat. No. 4,661,429 by incorporating a dye or pigment in the acid photogenerating layer which undergoes a color density or hue shift upon exposure of the photoelectrographic element with radiation. This dye or pigment achieves this result without adversely affecting the performance of the photoelectrographic element. As a result, visible electroconductive latent images are produced on the photoelectrographic element.

The present invention also provides a photoelectrographic imaging method which utilizes the above-described photoelectrographic element. This process comprises the steps of: exposing the acid photogenerating layer without prior charging to create a visible electroconductive latent image and printing by a sequence comprising: charging to create a visible electrostatic latent image, developing the electrostatic latent image with charged toner particles, transferring the toned image to a suitable receiver, and cleaning any residual, untransferred toner from the photoelectrographic element.

The imaging method and elements of the present invention use acid photogenerators in thin layers coated over a conductive layer to form images. This imaging technique or method takes advantage of the discovery that exposure of the acid generator significantly increases the conductivity in the exposed area of the layer. Imagewise radiation of the acid photogenerator layer creates a persistent differential conductivity between exposed and unexposed areas. This allows for the subsequent use of the element for printing multiple copies from a single exposure with only multiple charging, developing, transferring, and cleaning steps. This is different from electrophotographic imaging techniques where the electrophotographic element must generally be charged electrostatically followed by imagewise exposure for each copy produced. As a result, maximum throughput tends to be limited, and energy consumption is likely to be greater.

The charged toner may have the same sign as the electrographic latent image or the opposite sign. In the former case, a negative image is developed, while a positive image is developed in the latter.

By incorporating a dye or pigment which undergoes a color density or hue shift following exposure of the photoelectrographic element with radiation, a visible electroconductive latent image is produced. Visualization involving a color density shift could be either: (a) a bleach-out process in which the photoelectrographic element is colored in its unexposed state and bleached to a colorless or nearly colorless appearance upon exposure or (b) a print-out process in which the element is initially colorless or nearly colorless and develops color upon exposure. A bleach-out process can be regarded as a positive-positive process, because an image of density graduation equivalent to the original image is obtained. In a print-out process, an image with a density graduation complimentary to the original is produced, so it may be regarded as a negative-positive process. Where visualization of the electroconductive latent image involves a color hue shift, the photoelectrographic element is transformed from one color to another.

Although any color density or hue shift process would suffice in rendering the electroconductive latent image visible, it is particularly desirable to demonstrate these processes in a variety of colors. For example, in a multicolor process, where two or more elements are imaged and the elements correspond to different color records, it can be difficult to tell which color record a given element represents should the elements become misplaced. By choosing a dye or pigment which possesses a hue corresponding to the color records of interest, the color record corresponding to a given element can be easily determined. This is especially advantageous in a conventional four-color (cyan, magenta, yellow, and black) process utilizing four separate elements in parallel.

Using the photoelectrographic imaging method of the present invention produces a long-lasting electroconductive latent image which is not adversely affected by normal changes in temperature or humidity.

The ability to differentiate color-coded latent image print-out implies that some minimum level of white light exposure would be necessary to visualize the latent image. Thus, it is also an object of this invention that said electroconductive elements are substantially unaffected by a minimal exposure to room light.

While the foregoing discussion has dealt with print-out of the electroconductive latent image which is visible to the human eye, it would also be advantageous if the print-out or bleach-out were visualized by other means. For example, an image-wise density shift in the near-infrared region of the electromagnetic spectrum is useful in certain situations. It is therefore a further object of this invention to demonstrate print-out or bleach-out in the near-infrared region of the spectrum.

DETAILED DESCRIPTION OF THE INVENTION

As already noted, the present invention relates to a photoelectrographic element comprising a conductive layer in electrical contact with an acid photogenerating layer which is free of photopolymerizable materials and includes an electrically insulating binder, an onium acid photogenerator, and, optionally, a spectral sensitizer. In this element, the improvement resides in the use of a dye or pigment which undergoes a color density or hue shift following exposure of the photoelectrographic element with radiation to produce a visible electroconductive latent image. This result is achieved without adversely affecting the acid photogenerator.

The photoelectrographic imaging elements of the present invention include a support consisting of a flexible polyester base overcoated with a submicron cuprous iodide layer. Laminated to this conductive support is a barrier layer comprising 1–2 μm of cellulose nitrate, and on top of this barrier layer is the acid photogenerating layer.

In preparing acid photogenerating layers, the onium acid photogenerator, the electrically insulating binder, and the dye or pigment are co-dissolved in a suitable solvent, and the resulting solution is coated over the electrically conductive support.

Solvents of choice for preparing acid photogenerator coatings include a number of solvents including aromatic hydrocarbons such as toluene; ketones, such as acetone or 2-butanone; esters, such as ethyl acetate or methyl acetate, chlorinated hydrocarbons such as ethylene dichloride, trichloroethane, and dichloromethane, ethers such as tetrahydrofuran; or mixtures of these solvents.

The acid photogenerating layers are coated on a conducting support in any well-known manner such as by doctor-blade coating, swirling, dip-coating, and the like.

The onium acid photogenerating materials should be selected to impart relatively little conductivity before irradiation with the conductivity increasing after exposure. Useful results are obtained when the coated layer contains at least about 1 weight percent of the acid photogenerator. The upper limit of onium acid photogenerator is not critical as long as no deleterious effect on the initial conductivity of the film is encountered. A preferred weight range for the acid photogenerator in the coated and dried composition is from 15 weight percent to about 30 weight percent.

The thicknesses of the acid photogenerator layer can vary widely with dry coating thicknesses ranging from about 0.1 μm to about 50 μm. Coating thicknesses outside these ranges may also be useful.

In general, any compound which generates an acid upon near-infrared radiation exposure may be useful. Although there are many known acid photogenerators useful with ultraviolet and visible radiation, the utility of their exposure with near-infrared radiation is unpredictable. Potentially useful aromatic onium salt acid photogenerators are disclosed in U.S. Pat. Nos.

4,661,429, 4,081,276, 4,529,490, 4,216,288, 4,058,401, 4,069,055, 3,981,897, and 2,807,648 which are hereby incorporated by reference. Such aromatic onium salts include Group Va, Group VIa, and Group VIIa elements. The ability of triarylselenonium salts and triarylsulfonium salts to produce protons upon exposure to ultraviolet and visible light is also described in detail in "UV Curing, Science and Technology", Technology Marketing Corporation, Publishing Division, 1978.

A representative portion of useful Group Va onium salts are:

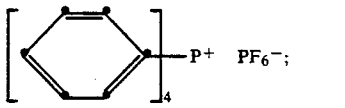

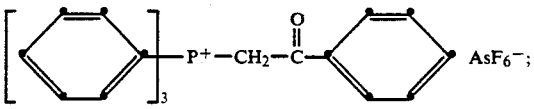

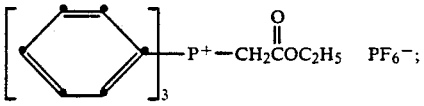

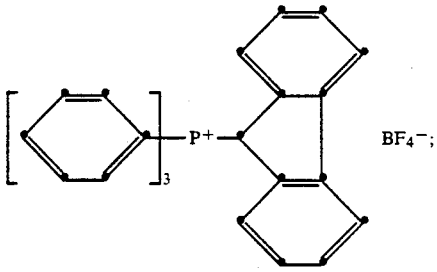

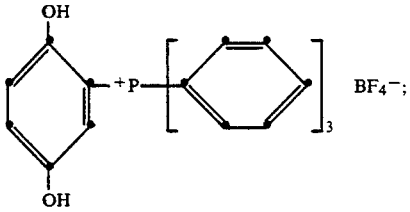

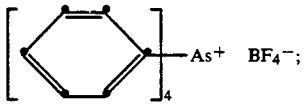

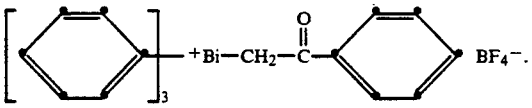

A representative portion of useful Group VIa onium salts, including sulfonium and selenonium salts, are:

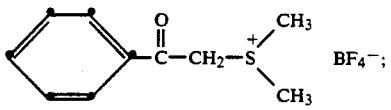

-continued

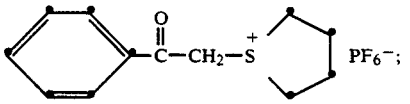

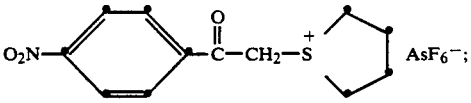

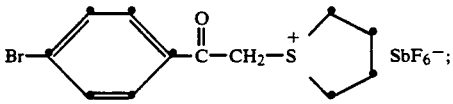

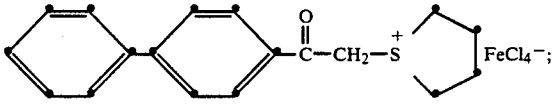

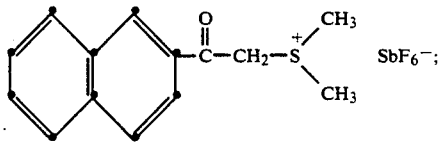

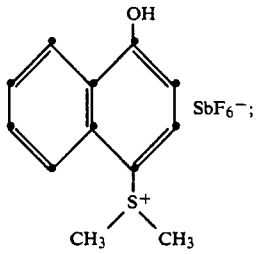

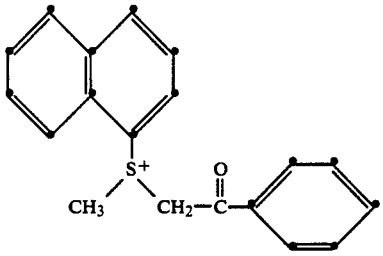

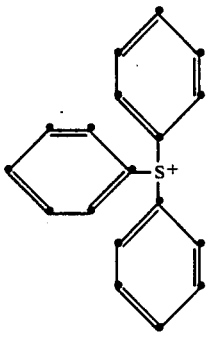

-continued
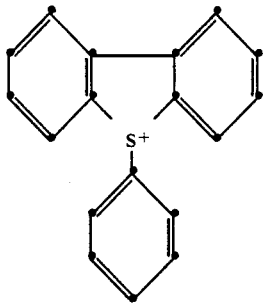
$BF_4^-$;
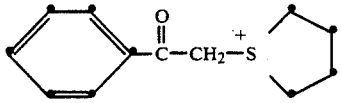
$PF_6^-$;
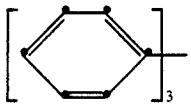
$BF_4^-$;
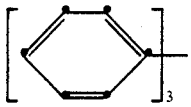
$PF_6^-$;
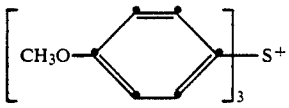
$AsF_6^-$; and
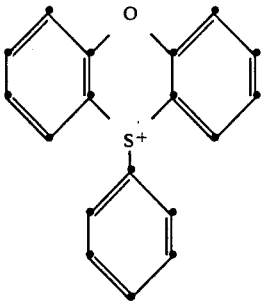
$AsF_6^-$.
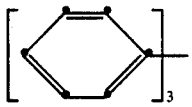
$BF_4^-$;
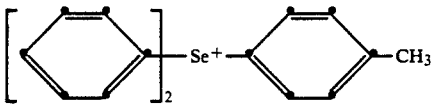
$SbF_6^-$; and
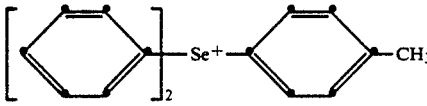
$AsF_6^-$.
A representative portion of the useful Group VIIa onium salts, including iodonium salts, are the following:
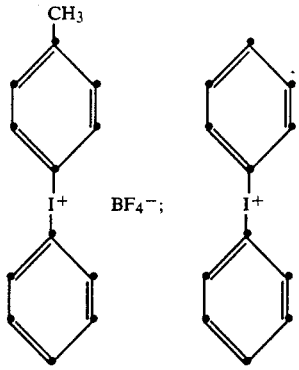
$BF_4^-$; $PF_6^-$;
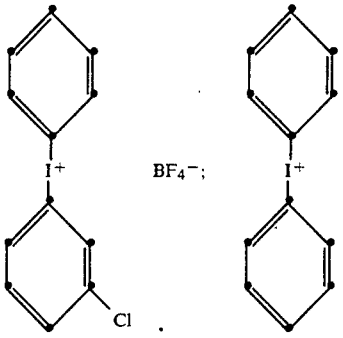
$BF_4^-$; $SbF_6^-$;
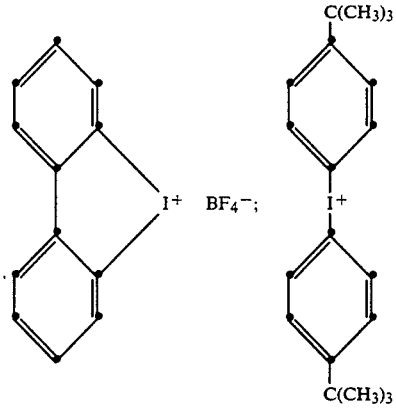
$BF_4^-$; $CF_3SO_3^-$;
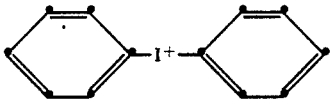
$BF_4^-$;
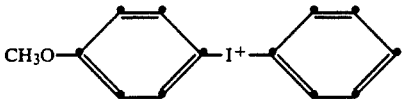
$BF_4^-$;
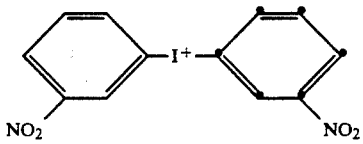
$AsF_6^-$;
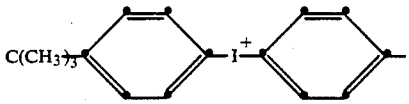
$SbF_6^-$;

-continued

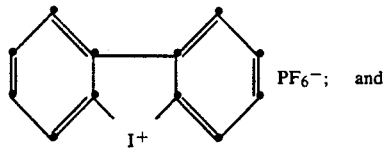

$PF_6^-$; and

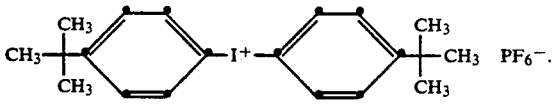

$PF_6^-$.

A particularly preferred class of onium acid photogenerators are the diaryliodonium salts, especially di-(4-t-butylphenyl)iodonium trifluoromethanesulfonate ("ITF").

Useful electrically insulating binders for the acid photogenerating layers include polycarbonates, polyesters, polyolefins, phenolic resins, and the like. Desirably, the binders are film forming. Such polymers should be capable of supporting an electric field in excess of $1\times10^5$ V/cm and exhibit a low dark decay of electrical charge.

Preferred binders are styrene-butadiene copolymers; silicone resins; styrene-alkyd resins; soya-alkyd resins; poly(vinyl chloride); poly(vinylidene chloride); vinylidene chloride, acrylonitrile copolymers; poly(vinyl acetate); vinyl acetate, vinyl chloride copolymers; poly(vinyl acetals), such as poly(vinyl butyral); polyacrylic and methacrylic esters, such as poly(methyl methacrylate), poly(n-butyl methacrylate), poly(isobutyl methacrylate), etc; polystyrene; nitrated polystyrene; poly(vinylphenol)polymethylstyrene; isobutylene polymers; polyesters, such as phenol formaldehyde resins; ketone resins; polyamides; polycarbonates; etc. Methods of making resins of this type have been described in the prior art, for example, styrene-alkyd resins can be prepared according to the method described in U.S. Pat. Nos. 2,361,019 and 2,258,423. Suitable resins of the type contemplated for use in the photoactive layers of this invention are sold under such tradenames as Vitel PE 101-X, Cymac, Piccopale 100, Saran F-220. Other types of binders which can be used include such materials as paraffin, mineral waxes, etc. Particularly preferred binders are aromatic esters of polyvinyl alcohol polymers and copolymers, as disclosed in pending U.S. Pat. application Ser. No. 509,119, entitled "Photoelectrographic Elements".

The binder is present in the element in a concentration of 30 to 98 weight %, preferably 55 to 80 weight %.

Useful conducting layers include any of the electrically conducting layers and supports used in electrophotography. These include, for example, paper (at a relative humidity above about 20 percent); aluminum paper laminates; metal foils, such as aluminum foil, zinc foil, etc.; metal plates, such as aluminum, copper, zinc, brass, and galvanized plates; regenerated cellulose and cellulose derivatives; certain polyesters, especially polyesters having a thin electroconductive layer (e.g , cuprous iodide) coated thereon; etc.

While the acid photogenerating layers of the present invention can be affixed, if desired, directly to a conducting substrate or support, it may be desirable to use one or more intermediate subbing layers between the conducting layer or substrate and the acid photogenerating layer to improve adhesion to the conducting substrate and/or to act as an electrical and/or chemical barrier between the acid photogenerating layer and the conducting layer or substrate.

Such subbing layers, if used, typically have a dry thickness in the range of about 0.1 to about 5 μm. Useful subbing layer materials include film-forming polymers such as cellulose nitrate, polyesters, copolymers or poly(vinyl pyrrolidone) and vinylacetate, and various vinylidene chloride-containing polymers including two, three and four component polymers prepared from a polymerizable blend of monomers or prepolymers containing at least 60 percent by weight of vinylidene chloride. Other useful subbing materials include the so-called tergels which are described in Nadeau et al., U.S. Pat. No. 3,501,301.

Optional overcoat layers are useful with the present invention, if desired. For example, to improve surface hardness and resistance to abrasion, the surface layer of the photoelectrographic element of the invention may be coated with one or more organic polymer coatings or inorganic coatings. A number of such coatings are well known in the art and, accordingly, an extended discussion thereof is unnecessary. Several such overcoats are described, for example, in *Research Disclosure,* "Electrophotographic Elements, Materials, and Processes", Vol. 109, page 63, Paragraph V, May, 1973, which is incorporated herein by reference.

The dye or pigment which undergoes a color density or hue shift following exposure can be any such material possessing this property but must not adversely interfere with the performance of the photographic element.

When the color density shift involves color bleaching, the photoelectrographic element is initially colored and is transformed to a colorless or near colorless state following exposure. The following dyes and pigments are suitable for achieving this result: quinaldine blue, quinoline yellow, 7-diethyldiamino-3-thenoylcoumarin, bromocresol green, quinaldine red, leuco malchite green, indophenol blue, 1,1'-diethyl-2,2'-cyanine iodine, crystal violet, ethyl red, and ethyl violet. It is particularly desirable to utilize a set of one or more dyes or pigments which result in elements which initially are magenta, cyan, and yellow in color. As a result, various combinations of dyes and pigments can be used to produce elements with a virtually limitless range of colors (including visually neutral densities) which can ultimately be bleached out. For example, when quinaldine red or quinaldine blue are used in conjunction with the acid photogenerating layer, photoelectrographic imaging element, the element, in the unexposed state, appears magenta or cyan in color, respectively. If elements are desired which appear yellow in the unexposed state, compounds such as bromocresol green or 7-diethylamino-3-thenoylcoumarin may be added. When such elements are exposed with imaging radiation, the exposed areas are bleached to the same pale amber color as the control film without dye, and the degree of bleaching is proportional to the amount of imaging radiation impinging on the element. Moreover, these dyes have no noticeable effect on any of the other desirable features of these imaging elements:

When the color density shift involves color print out, the element is initially colorless or near colorless and is transformed to a colored state following exposure. In this case, the dye or pigment can be m-cresol purple, p-phenylazophenol, or 10-methyl-9(10H)-acridone.

Should it be desired to have the photoelectrographic element undergo a color hue shift, the following dye and pigments should be utilized: bromocresol purple, propyl red, brilliant green, malachite green oxalate, methyl violet, crystal violet, methyl green, ethyl violet, curcumin, dithizone, coumarin 7, coumarin 338, coumarin 6, coumarin 30 and coumarin 334.

The acid photogenerating layer contains 0.1 to 30, preferably 1-15, weight percent of dye or pigment. The thickness of the acid generating layer ranges from 1 to 30 μm, preferably 5 to 10 μm.

In some cases, it may be optionally desirable to incorporate a sensitizer in the photoelectrographic element. The amount of sensitizer used varies widely, depending upon the type and thickness of the acid photogenerator used as well as the particular sensitizer used. Generally, the sensitizer can be present in an amount of up to about 30 percent by weight of the acid generating composition.

Iodonium salt acid photogenerators may be sensitized with ketones such as xanthones, indandiones, indanones, thioxanthones, acetophenones, benzophenones, or other aromatic compounds such as anthracenes, dialkoxyanthracenes, perylenes, phenothiazines, etc. Triarylsulfonium salt acid photogenerators may be sensitized by aromatic hydrocarbons, anthracenes, perylenes, pyrenes, and phenothiazines. 9,10-diethoxyanthracene is a particularly preferred sensitizer. Sensitizers should be those which do not adversely affect the desired appearance of the visible electroconductive latent image.

The photoelectrographic elements of the present invention are employed in the photoelectrographic process summarized above. This process involves a 2-step sequence—i.e. an exposing phase followed by a printing phase.

In the exposing phase, the acid photogenerating layer is exposed imagewise to radiation without prior charging to create a visible electroconductive latent image. Once the exposing phase is completed, a visible electroconductive latent image exists on the element, and no further exposure is needed. The element may then be subjected to the printing phase either immediately or after some period of time has passed.

In the printing phase, the element is given a blanket electrostatic charge, for example, by passing it under a corona discharge device, which uniformly charges the surface of the acid photogenerator layer. The charge is dissipated by the layer in the exposed areas, creating a visible electrostatic latent image. The electrostatic latent image is developed with charged toner particles, and the toned image is transferred to a suitable receiver (e.g., paper). The toner particles can be fused either to a material (e.g., paper) on which prints are actually made or to an element to create an optical master or a transparency for overhead projection. Any residual, untransferred toner is then cleaned away from the photoelectrographic element.

The toner particles are in the form of a dust, a powder, a pigment in a resinous carrier, or a liquid developer in which the toner particles are carried in an electrically insulating liquid carrier. Methods of such development are widely known and described as, for example, in U.S. Pat. Nos. 2,296,691, 3,893,935, 4,076,857, and 4,546,060.

By the above-described process, multiple prints from a single exposure can be prepared by subjecting the photoelectrographic element only once to the exposing phase and then subjecting the element to the printing phase once for each print made.

The photoelectrographic layer can be developed with a charged toner having the same polarity as the latent electrostatic image or with a charged toner having a different polarity from the latent electrostatic image. In one case, a positive image is formed. In the other case, a negative image is formed. Alternatively, the photoelectrographic layer can be charged either positively or negatively, and the resulting electrostatic latent images can be developed with a toner of given polarity to yield either a positive or negative appearing image.

The invention is further illustrated by the following examples which include preferred embodiments thereof.

EXAMPLES

In the examples which follow, the preparation of representative materials, the formulation of representative film packages, and the characterization of these films are described. These examples are provided to illustrate the usefulness of the photoelectrographic element of the present invention and are by no means intended to exclude the use of other elements which fall within the above disclosure.

EXAMPLE 1

A polyester support was coated successively with solutions of (i) cuprous iodide (3.4 wt %) and poly(vinyl formal) (0.32 wt %) in acetonitrile (96.3 wt %) and (ii) cellulose nitrate (6 wt %) in 2-butanone (94 wt %) so that layer (i) is about 0.5 μm thick and layer (ii) is about 1.5 μm thick. A formulation consisting of di-(t-butylphenyl)iodonium triflate (3.0 wt %), 9,10-diethoxyanthracene (0.6 wt %), and poly(vinyl benzoate-co-vinyl acetate) 8.4 wt %) in dichloromethane (79.2 wt %) and 1,1,2-trichloroethane (8.8%) was completely dissolved and was coated over the above layer (ii) to a thickness of about 9 μm. This film has a very pale amber color, and spectroscopy shows strong absorption in the UV region, with absorption maxima near 370, 390, and 410 nm due to the 9,10-diethoxyanthracene. Photomicroscopy indicates that the acid photogenerating layer is 8.8 μm thick. Upon imaging with light from a 500-W mercury arc lamp with total irradiance of about 3 joules/cm$^2$, no noticeable change in the color or density is observed.

The photoelectrographic properties of this film were evaluated by mounting it in electrical contact with a metal drum and rotating the drum past a corona charger and an electrostatic voltmeter. The configuration causes a given area of the film to pass in front of the charger and voltmeter once every second, with the time between the charger and voltmeter being about 200 msec. The grid potential on the charger is set at +700 V with 0.40 ma current. After several cycles, both exposed and unexposed regions of the film reach equilibrium potentials. The equilibrium potential in the unexposed region is termed $V_{max}$ and the equilibrium potential in the exposed region is termed $V_{min}$. The difference between $V_{max}$ and $V_{min}$ is called delta V and represents the potential available for development. The degree of discharge, i.e., the ratio of delta V to $V_{max}$, has been found to be essentially independent of $V_{max}$ in the range of 400 to 800 V. For the purpose of comparing the photoelectrographic behavior of the control formulation and the various inventive formulations, the values of $V_{max}$ and (delta V)/$V_{max}$ will be used. When the control formulation was characterized as just described under the conditions of 69° F. and 35% relative humidity ("RH"), $V_{max}$=755 V and (delta V)/$V_{max}$=0.86.

EXAMPLE 2

A number of commercially available dyes were surveyed in formulations similar to that just described. Table I below summarizes those dyes for which some level of success was achieved. In most of the entries listed, di-(t-butylphenyl)iodonium triflate and 9,10-diethoxyanthracene were present at 20 and 5 wt %, respectively, with the following exceptions: Tests S through W and DD contained 25% wt % di-(t-butylphenyl)iodonium triflate, Test EE contained 25 wt % triphenylsulfonium hexafluorophosphate, and Test F contained 2.5 wt % 9,10-diethoxyanthracene. Dye levels were not optimized and ranged between 0.25 and 3.0 wt %. The remaining mass of the films was composed of binder resin.

This example illustrates the unpredictable nature of the invention. Many of the dyes listed in Table I are not normally considered acid-base indicators, which demonstrates that the present invention is not restricted to conventional acid-base indicators. Furthermore, of those conventional acid-base indicators tested, not all of them gave the expected color changes. For example, bromocresol green is purported to appear blue in its unprotonated form and change to yellow when protonated. In the present invention (Table I, Test D), it starts out yellow and bleaches to a pale yellow upon exposure. By contrast, U.S. Pat. No. 4,659,649 to Dickinson et al. ("Dickinson") disclosed that the same dye changes from green to yellow. Another dye which behaves differently is leuco malachite green (Table I, Test A). In Dickinson, a change of colorless to green is observed upon exposure, while, in the present invention, there is a change from blue-green to pale yellow.

Further adding to the unpredictability of the invention is that, in addition to those dyes listed in Table I, a number of other dyes were either insoluble or inactive. Insufficiently soluble dyes included: titan Yellow, alizarin yellow R, p-nitrobenzenediazonium tetrafluoroborate, and cresol red. The following dyes gave negligible hue and/or density shifts: 5-nitrosalicylaldehyde, bromocresol green, phenanthrenequinone, pinacryptol yellow, saffron, thioflavin S, sudan I, sudan II, azoene, ethyl bis(2,4-dinitrophenyl)acetate, 2-(2,4-dinitrophenylazo)-1-naphthol-3,6-disulfonic acid disodium salt, fast corinth V salt, 4-diazo-N,N-diethylaniline fluoborate, fast garnet GBC salt, fluorescein, 1-ethylquinaldinium iodide, 1-ethylquinolinium iodide, 3-ethylrhodanine, and coumarin 337.

Test EE shows that acid photogenerating compounds other than iodonium salts may be used in the inventive formulations.

Tests FF and GG illustrate dyes which bleach in the near infrared region of the spectrum.

TABLE I

| TEST | DYE | APPEARANCE Unexp. | Exposed | PROCESS |
|---|---|---|---|---|
| A | leuco malachite green | blue-green | pale yellow | bleach |
| B | indophenol blue | cyan-blue | pale yellow | bleach |
| C | m-cresol purple | pale yellow | red | print-out |
| D | bromocresol green | yellow | pale yellow | bleach |
| E | bromocresol purple | yellow | orange | hue shft. |

TABLE I-continued

| TEST | DYE | APPEARANCE Unexp. | Exposed | PROCESS |
|---|---|---|---|---|
| F | propyl red | pink | magenta | hue shft. |
| G | brilliant green | green | amber | hue shft. |
| H | malachite green oxalate | green | olive | hue shft. |
| I | methyl violet | blue | green | hue shft. |
| J | crystal violet | blue | qreen | hue shft. |
| K | methyl green | green | olive | hue shft. |
| L | ethyl violet | blue | olive | hue shft. |
| M | curcumin | yellow | olive | hue shft. |
| N | dithizone | cyan | gray | hue shft. |
| O | p-phenylazophenol | pale yellow | bright yellow | print-out |
| P | quinaldine blue (pinacyanol chloride) | cyan | pale green | bleach |
| Q | acridine orange base | orange | less orange | bleach |
| R | quinoline yellow | yellow | less yellow | bleach |
| S | 7-diethylamino-3-thenoylcoumarin | yellow | pale yellow | bleach |
| T | 1,1'-diethyl-2,2' cyanine iodide | pink | pale yellow | bleach |
| U | crystal violet | blue | pale olive | bleach |
| V | ethyl red | violet | pale yellow | bleach |
| W | ethyl violet | blue | pale yellow | bleach |
| X | coumarin 7 | yellow | orange | hue shft. |
| Y | coumarin 338 | yellow | amber | hue shft. |
| Z | 10-methyl-9(10H)-acridone | color-less | amber | print-out |
| AA | coumarin 6 | orange | magenta | hue shft. |
| BB | coumarin 30 | yellow | orange | hue shft. |
| CC | coumarin 334 | yellow | orange | hue shft. |
| DD | quinaldine red | magenta | pale pink | bleach |
| EE | quinaldine red | magenta | pale pink | bleach |
| FF | 1,1'-diethyl-2,2'-dicarbocyanine iodide | pale green | pale yellow | bleach |
| GG | cryptocyanine | green | pale yellow | bleach |

EXAMPLE 3

This example compares the photoelectrographic behavior of the present invention as a function of RH of a control film containing no dye with a film containing 1.5 wt % indophenol blue, a preferred dye of U.S. Pat. No. 4,659,649. The Films were coated as described in Example 1. The control film consists of 20 wt % of di-(t-butylphenyl)iodonium triflate, 5 wt % 9,10-diethoxyanthracene, and 75 wt % poly(vinyl-m-bromo benzoate-co-vinyl acetate) ("PVmBB"). For the film containing the indophenol blue, 1.5 wt % of the PVmBB was replaced with an equal weight of the dye. Film thicknesses were 7.0 ±0.2 μm for the top layer in each case.

The photoelectrographic behavior of these films was evaluated in the following manner. Four samples, approx. 2"×2" square, were cut from each film. Two of these samples were equilibrated overnight at 73° F./95% RH, and the other two were equilibrated under ambient conditions—i.e., 73° F/36% RH. One sample from each of these two sets was exposed (ca. 3 joules/cm$^2$), electrostatistically charged with a single-wire corona biased to +7 kV at 50 μA current for 10 sec., and then immediately read by a probe connected to a Monroe Electronics Model 144D-4 electrostatic voltmeter. $V_{max}$ is taken as the initial voltage reading for each of the unexposed samples, and $V_{min}$ is taken as the initial reading for each of the exposed samples. Delta V and delta V)/$V_{max}$ were calculated as described in Example 1. Results are summarized in Table II, and clearly indicate that indophenol blue adversely affects the photoelectrophotographic performance of the formulation.

To show that the poor performance of Test B was not an artifact of the method used to evaluate the films in Table II, it was also evaluated in exactly the same manner as described in Example 1. At 69° F./33% RH, $V_{max}$=747 V, and delta V/$V_{max}$=0.42, and, at 79° F./68% RH, $V_{max}$=400 V, and delta V/$V_{max}$=0.42.

TABLE II

| TEST | DYE | Vmax (73° F./36% RH) | delta V/Vmax | Vmax (73° F./95% RH) | delta V/Vmax |
|---|---|---|---|---|---|
| A | None | 610 V | 0.77 | 580 V | 0.91 |
| B | Indo-phenol | 640 | 0.23 | 320 | 0.47 |

EXAMPLE 4

Three of the dyes listed in Table I were incorporated into films and compared to a control containing no dye (Example 1). These examples illustrate a set of cyan, magenta, and yellow bleach-out formulations which behave comparable to the control. These films were prepared exactly as described in Example 1. The dyes quinaldine red, quinaldine blue, and 7-diethylamino-3-thenoylcoumarin (DEATC) were incorporated, at concentrations of 0.3, 0.3, and 0.5 wt %, respectively. The iodonium salt and sensitizer were present at 25 and 5 wt %, respectively. The balance of each film consisted of the binder, in this case poly(vinyl benzoate-co-vinyl acetate). These films were characterized in the same manner as described in Example 1. The data are summarized below in Table III. It can be seen that none of these dyes adversely impact the electrical behavior of the formulation.

Bleach-out images were made by contact-exposing test films B, C, and D through a high contrast separation using an exposure identical to that above. Clear, crisp bleach-out images were obtained. In the case of quinaldine blue (Test C), the unexposed areas are cyan-blue in color. For 7-diethylamino-3-thenoylcoumarin (Test D), the unexposed regions are lemon yellow. For quinaldine red (Test B), the unexposed portions are magenta. These images have been viewed on numerous occasions and under various conditions, including standard office fluorescent lights, diffuse window sunlight, and with an overhead projector. No noticeable loss in image density has occurred.

Test films B and C were also evaluated for their sensitivity to room lights as follows. Samples of each were placed at a distance of 2 feet from a 30-watt fluorescent desk lamp. Half of each sample was covered with a thick piece of cardboard. After 9 min. of exposure under these conditions, the films were evaluated as described in Example 1, at 70° F./30% RH. The ratio of delta V to $V_{max}$ was less than 0.01 for test film B and 0.04 for test film C. Although the density of the exposed region of each sample appeared to be hardly changed from the unexposed region, the exposed areas of each sample were evaluated by spectroscopy. Test film B showed only an 8% loss of density at its absorption maximum of 538 nm, and test film C showed only a 16% loss of density at its maximum of 620 nm. These results indicate that these films can tolerate substantial exposure to room light with negligible adverse affect.

The experiment was repeated, and this time each sample received 147 min. of exposure from the same fluorescent desk lamp. The ratio of delta V to $V_{max}$ was 0.13 for test film B and 0.16 or test film C. The densities of the exposed areas were clearly reduced compared to the unexposed areas. Spectroscopy showed that test film B lost 54% of its density at its absorption maximum of 538 nm, and test film C lost 66% of its density at its maximum of 620 nm. These results show that overexposure to room lights, to the extent that the electrical behavior may be adversely affected, is evidenced by a noticeable loss in optical density, and can be readily detected by the human eye. Thus, the inventive formulations also contain built-in indicators of excessive non-imaging exposure, i.e., "fog." Additional samples of test films B and C were contact-exposed through a ByCHROME TM percentage-calibrated screen tint (made by ByChrome Co., Columbus, Ohio), using a 3 joules/cm$^2$ exposure. Crisp, clear images were obtained, and dot integrity is maintained across virtually the entire range of line screens and percent dots. Photomicrographs (100 ×) of the 60% dots at the 65 line screen for each sample are virtually identical in both size and shape to those taken of the original. This shows that the bleach-out images are capable of reproducing the original separations with high integrity.

TABLE III

| TEST | DYE | Vmax (73° F./36% RH) | delta V/Vmax | Vmax (73° F./95% RH) | delta V/Vmax |
|---|---|---|---|---|---|
| A | None (control) | 755 V | 0.86 | 535 V | 0.93 |
| B | Quinaldine red | 747 | 0.88 | 615 | 0.92 |
| C | Quinaldine blue | 745 | 0.89 | 612 | 0.93 |
| D | DEATC | 838 | 0.76 | 629 | 0.92 |

Although the invention has been described in detail for the purpose of illustration, it is understood that such detail is solely for that purpose, and variations can be made therein by those skilled in the art without departing from the spirit and scope of the invention which is defined by the following claims.

What is claimed is:

1. An element suitable for photoelectrographic imaging comprising a conductive layer in electrical contact with an acid photogenerating layer which is free of photopolymerizable materials and comprises an electrically insulating binder and an onium acid photogenerator, wherein the improvement comprises:

a dye or pigment in the acid photogenerating layer which undergoes a color density or hue shift upon exposure of said element with radiation without adversely affecting the onium acid photogenerator and which concurrently generates a visible electroconductive latent image on said element.

2. An element according to claim 1, wherein the onium acid photogenerator is an aromatic onium salt selected from the group consisting of Group Va, Group VIa, and Group VIIa elements.

3. An element according to claim 2, wherein the onium acid photogenerator is an aromatic onium salt selected from the group consisting of aryl halonium salts, aryl phosphonium salts, aryl arsenonium salts, aryl sulfonium salts, triaryl selenonium salts, and mixtures thereof.

4. An element according to claim 3, wherein the onium acid photogenerator is di-(4-t-butylphenyliodonium trifluoromethanesulfonate).

5. An element according to claim 1, wherein said element undergoes a color density shift upon exposure.

6. An element according to claim 5, wherein the color density shift involves color bleaching, whereby said element is initially colored and is transformed to a colorless or near colorless state upon exposure.

7. An element according to claim 6, wherein said dye or pigment is selected from the group consisting of quinaldine blue, quinoline yellow, 7-diethyldiamino-3-thenoylcoumarin, bromocresol green, quinaldine red, leuco malchite green, indophenol blue, 1,1'-diethyl-2,2'-cyanine iodide, crystal violet, ethyl red, and ethyl violet.

8. An element according to claim 6, wherein said dye or pigment undergoes color bleaching upon exposure to near-infrared radiation and is selected from the group consisting of 1,1'-diethyl-2,2'-dicarbocyanine iodide and cryptocyanine.

9. An element according to claim 6, wherein the color bleaching is carried out for a color selected from the group consisting of cyan, magenta, and yellow.

10. An element according to claim 5, wherein the color density shift involves color print out, whereby said element is initially colorless or near colorless and is transformed to a colored state upon exposure.

11. An element according to claim 10, wherein said dye or pigment is selected from the group consisting of m-cresol purple, p-phenylazophenol, and 10-methyl-9(10H)-acridone.

12. An element according to claim 1, wherein said element undergoes a color hue shift upon exposure.

13. An element according to claim 12, wherein said dye or pigment is selected from the group consisting of bromocresol purple, propyl red, brilliant green, malachite green oxalate, methyl violet, crystal violet, methyl green, ethyl violet, curcumin, dithizone, coumarin 7, coumarin 338, coumarin 6, coumarin 30, and coumarin 334.

14. An element according to claim 1, wherein the binder is selected from the group consisting of polycarbonates, polyesters, polyolefins, phenolic resins, paraffins, and mineral waxes.

15. An element according to claim 14, wherein the binder is an aromatic ester of a polyvinyl alcohol polymer.

16. An element according to claim 1 further comprising:

a spectral sensitizer.

17. An element according to claim 16, wherein said spectral sensitizer is selected from the group consisting of xanthones, indandiones, indanones, throxanthones, acetophenones, benzophenones, anthracenes, dialkoxyanthracenes, perylenes, phenothiazines, and pyrenes.

18. A photoelectrographic method for printing using a photoelectrographic element comprising a conductive layer in electrical contact with an acid photogenerating layer which is free of photopolymerizable materials and comprises an electrically insulating binder, an onium acid photogenerator, and a dye or pigment which undergoes a color density or hue shift upon exposure of said photoelectrographic element with radiation without adversely affecting the onium acid photogenerator, said method comprising:

exposing the acid photogenerating layer imagewise to radiation without prior charging to create a visible electroconductive latent image and printing an image from the visible electroconductive latent image, said printing comprising:

charging said element with the acid photogenerating layer having a visible electroconductive latent image to create a visible electrostatic latent image;

developing the electrostatic latent image by applying charged toner particles to said element to produce a toned image; and transferring the toned image to a suitable receiver, wherein said printing is carried out one time for each print made.

19. A method according to claim 18, wherein the acid photogenerator is an aromatic onium salt selected from the group consisting of Group Va, Group VIa, and Group VIIa elements.

20. A method according to claim 19, wherein the onium acid photogenerator is di-(4-t-butylphenyliodonium trifluoromethanesulfonate).

21. A method according to claim 18, wherein the dye or pigment causes said element to undergo a color density shift involving color bleaching, whereby said element is initially colored and is transformed to a colorless or near colorless state upon said exposing.

22. A method according to claim 20, wherein the color bleaching is carried out for a color selected from the group consisting of cyan, magenta, and yellow.

23. A method according to claim 20, wherein the color bleaching results from carrying out said exposing with near infrared radiation.

24. A method according to claim 18, wherein the dye or pigment causes said element to undergo a color density shift involving color print out, whereby said element is initially colorless or near colorless and is transformed to a colored state upon said exposing.

25. A method according to claim 18, wherein the dye or pigment causes said element to undergo a color hue shift upon said exposing.

26. A method according to claim 18 further comprising:

cleaning any residual toner particles not transferred to the receiver from said element for each print made.

27. A method according to claim 18, wherein the receiver is a substrate for permanently receiving a toned image as a print.

28. An element suitable for photoelectrographic imaging comprising a conductive layer in electrical contact with an acid photogenerating layer which is free of photopolymerizable materials and comprises an electrically insulating binder selected from the group consisting of polycarbonates, polyesters, polyolefins, phenolic resins, paraffins, and mineral waxes and an onium acid photogenerator selected from the group consisting of aromatic onium salts containing elements from the group consisting of Group Va, Group VIa, and Group VIIa elements, wherein the improvement comprises:

a dye or pigment in the acid photogenerating layer which undergoes a color bleaching, color print out, or color hue shift upon exposure of said element with radiation without adversely affecting the onium acid photogenerator and which concurrently generates a visible electroconductive latent image on said element.

* * * * *